US006004404A

United States Patent [19]

Ackerman

[11] Patent Number: 6,004,404

[45] Date of Patent: Dec. 21, 1999

[54] PRODUCT CLEANER

[75] Inventor: Kyle D. Ackerman, Dassel, Minn.

[73] Assignee: Carter Day International, Minneapolis, Minn.

[21] Appl. No.: 08/512,276

[22] Filed: Aug. 18, 1995

[51] Int. Cl.[6] ..... B08B 5/04

[52] U.S. Cl. ..... 134/21; 15/305; 15/306.1; 15/308; 15/309.2; 209/683

[58] Field of Search ..... 15/306.1, 308, 15/309.2, 305; 209/683

[56] References Cited

FOREIGN PATENT DOCUMENTS

| | | | |
|---|---|---|---|
| 295347 | 10/1968 | Canada | 15/305 |
| 1222479 | 6/1987 | Canada | 209/683 |

OTHER PUBLICATIONS

Set of 8 engineering drawings illustrating a cleaner sold by assignee more than one year prior to filing date of present application.

*Primary Examiner*—Chris K. Moore
*Attorney, Agent, or Firm*—Briggs and Morgan; Craig Gregersen

[57] ABSTRACT

The present invention provides a cleaner having a hopper for receiving dirty product to be cleaned. The hopper feeds the dirty or contaminated product downwardly onto a cleaning comb that directs the larger sized contaminants onto the exterior surface of a scalping reel having a plurality of apertures of a preselected size and shape. The dirty or contaminated material falls through the screen openings into the interior thereof and on out through the screen at the bottom thereof as it rotates. The dirty or contaminated material is then directed into a vertically oriented aspiration column that has a negative airflow from the bottom thereof upwardly. Fines, chaff, and other light contaminants are carried upwardly by the negative airflow and out of the product, which drops on downwardly into an outlet into a storage facility or onto a conveyor as desired by the cleaner operator. A vacuum nozzle is disposed in close proximity to the scalping reel to remove contaminants that may become lodged in the apertures. The vacuum nozzle is connected to the outlet of the aspiration column.

11 Claims, 4 Drawing Sheets

PRODUCT CLEANER

FIELD OF THE INVENTION

The present invention relates to apparatus used to separate unwanted materials from wanted material in general and to such apparatus used to separate unwanted streamers, chaff and fines from particulate matter, such as plastic beads or grain, in particular.

BACKGROUND OF THE PRESENT INVENTION

The use of a variety of machinery to clean dirty product, whether the product be grain, plastic beads, or other particulate matter, has long been known. Some of these machines rely on a means such as rotating screens or woven wire cages to sift the material and sort the desired material from the undesired material. For example, trommels having rotating screens are used to remove rocks, fines, chaff or other unwanted debris or contaminants from grain. In this sense, the words "debris" and "contaminants" simply refer to materials other than that desired in the product after it has been through the cleaning process. In these machines the grain is introduced at one end of a rotating, cylindrically configured, perforated screen or woven wire cage. As the grain flows through the rotating screen, for example, the material in the grain smaller than the perforations falls through the perforations into a discharge means and the grain moves onward and exits the rotating screen at the screen discharge end. In this way, material contaminants that differ in dimension from the wanted material can be removed.

Machines similar to these may be used to size the particulate matter, allowing product having certain dimensions to pass through the perforations or cage openings while retaining product too large to pass through these holes. In this manner, the product can be repeatedly sorted into two separate sizes with each sort. Such rotating screens are also used to size material. For example, clean grain can be introduced into a rotating screen and kernels of grain below a certain size will be sorted by the screen from the larger kernels since only the smaller kernels will pass through the openings in the screen. In this way, then, the grain can be sorted by kernel size, an important factor in determining seed count and plant count per acre when planting seed.

Besides the rotating screens, aspiration is sometimes used in machines to clean contaminants from a material. In equipment of this type, air is passed in some manner, either by suction or blowing, through the material and the contaminants are blown away from the desired material. Some machines used to clean grain or other particulate matter, such as plastic beads, utilize both types of cleaning operations.

In the plastics industry raw plastic that is manufactured by the plastic producer is delivered in bulk to a plastics molder who takes the raw plastic and molds it into product. Some raw plastic is produced as beads or pellets of a certain desired size and shipped to the molder. In the plastic producer's operation the plastic beads are often transported around the production plant by pneumatic conveyance through pipes around the facility. These pipes of necessity bend or turn on occasion and a certain portion of the plastic beads blowing through the pipe will rub against the interior pipe surface. This rubbing engagement generates sufficient heat that the plastic beads will partially melt and will begin to trail a "tail" formed of the previously melted plastic. These plastic streamers, sometimes called "angel hair," is undesirable and must be removed before the raw plastic can be molded into product. Too much of this form of contaminant can cause the raw plastic shipment to be rejected by the raw plastic producer's customer. Where the shipment is a train car full of the material, the economic loss due to a rejection because of angel hair can be considerable.

The cleaning machines used to clean angel hair from plastic beads typically use both an air flow and a rotating screen. Where a rotating perforated screen or mesh is used in the cleaning or sizing process, the screen perforations will over time become plugged, impairing or destroying the effectiveness of the cleaning or sizing process. Assorted apparatus has been used to clean the rotating screen with varying degrees of success that is dependent in part on the contaminants being removed from the desired clean material. With the plastic streamers or angel hair previously described, the perforations can quickly become plugged and the cleaning operation will be less effective.

Present day cleaners may use a rotating cleaner that wipes the rotating screen to remove contaminants lodged in the perforations. These cleaners typically comprising a rotating shaft having a plurality, often five, of flexible vanes extending outwardly therefrom. The vanes wipe against the rotating screen and force contaminants lodged therein out of the perforations. Another form of screen or cage cleaner may comprise a cylindrical brush whose bristles wipe against the screen or cage. Where the contaminant is something like "angel hair," however, the elongated, spaghetti like plastic can become nearly permanently stuck in the perforations and can eventually plug enough of the perforations to reduce the efficiency of the contaminant removal process performed by the machine.

It would be desirable to have an improved cleaner for a rotating screen that removes streamers or other filamentous or spaghetti-like contaminants, and other debris or contaminants from a particulate material and that improved the general product cleaning process.

SUMMARY OF THE INVENTION

It is an object of the present invention to provide new and improved apparatus that is not subject to the foregoing disadvantages.

It is another object of the present invention to provide an improved particulate matter cleaner that utilizes both the rotating screen and an aspirating negative airflow to clean unwanted materials from the particulate matter.

It is yet another object of the present invention to provide an improved particulate matter cleaner that utilizes a negative airflow to remove unwanted materials from the rotating screen.

It is still yet another object of the present invention to provide a particulate matter cleaner useful for removing streamers or other filamentous contaminants from the particulate matter.

It is still further another object of the present invention to provide a particulate matter cleaner that utilizes an aspirating negative airflow to remove filamentous contaminants from the particulate matter.

It is another object of the present invention to provide a particulate matter cleaner that utilizes a negative airflow to remove filamentous and other contaminants from the particulate matter and the rotating screen.

The foregoing objects of the present invention are provided by a cleaner having an overhead feed into a hopper for feeding material to be cleaned. The hopper feeds the dirty or contaminated material downwardly onto a cleaning comb that directs the larger sized contaminants onto the exterior surface of a rotating screen, commonly called a scalping reel, having a plurality of openings, commonly perforations, perforations of a preselected size and shape or, in other embodiments of such cleaners, onto the exterior surface of a woven wire cage. The dirty or contaminated material falls through the screen openings (or cage openings as the case may be) into the interior thereof and on out through the screen (or cage) at the bottom thereof as it rotates. The dirty or contaminated material is then directed into a vertically oriented aspiration tube that has a negative airflow from the bottom thereof upwardly. Fines, chaff, short streamers, and other light contaminants are carried upwardly by the negative airflow and out of the desired materials, which drops on downwardly into an outlet into a storage facility or onto a conveyor as desired by the cleaner operator.

Streamers such as angel hair or other filamentous contaminants will not generally pass through the perforations in the rotating screen though they may become lodged therein. As the screen rotates away from the falling dirty or contaminated material carrying therewith the larger sized contaminants screened by the cleaning comb, the screen surface will also carry the filamentous material caught in the holes or otherwise lodged thereon away. As the filamentous materials are carried away from the dirty or contaminated material by the rotating surface they will encounter a nozzle placed in close proximity to the scalping reel and having a negative air flow, that is a suction, that will pull the filamentous material therein into a vacuum plenum. The filamentous material will be carried by the negative airflow into a vacuum plenum return that carries away the contaminants from the cleaned material.

The foregoing objects of the invention will become apparent to those skilled in the art when the following detailed description of the invention is read with the accompanying drawings and claims. Throughout the drawings, like numerals refer to similar or identical parts.

DETAILED DESCRIPTION OF THE INVENTION

In the discussion of the present invention to follow, it will be assumed for purposes of illustration that the dirty product being supplied to the cleaning apparatus comprises plastic beads having angel hair and other contaminants such as plastic dust therein. It will be understood that the present invention is not so limited, however, and could be used in the removal of debris and contaminants from other forms of product, such as other particulate matter like grain, for example. Furthermore, it will be understood that such material will be generally referred to as product hereafter, and as dirty product before cleaning and cleaned product after cleaning. It will be further understood that the reference to cleaned product does not mean that all contaminants of every kind have been removed by the cleaner to be hereafter described.

Figure 1:
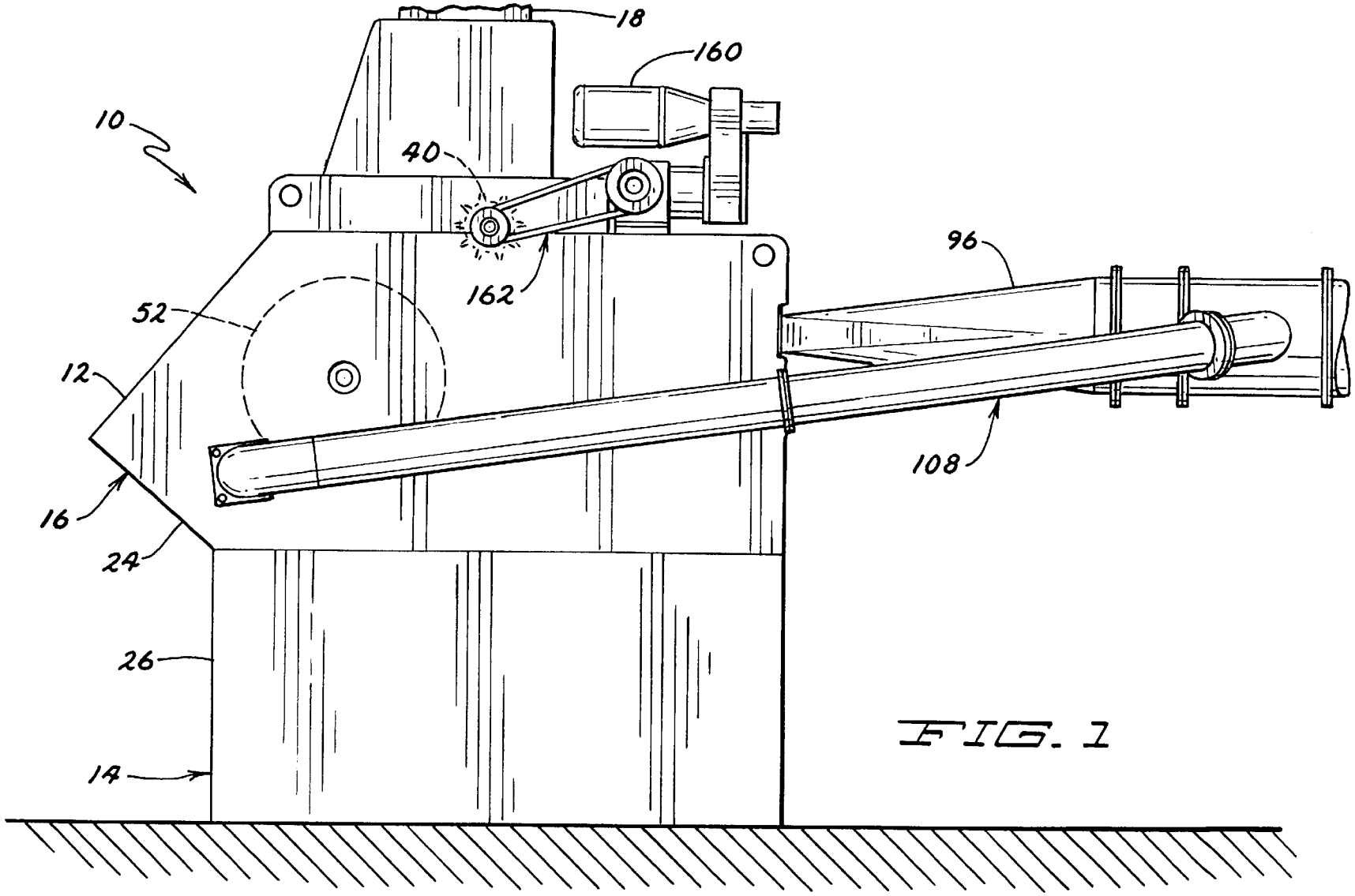
FIG. 1 illustrates the present invention in a side elevation view.

Referring now to the Figures, FIG. 1 illustrates a cleaner 10 in accord with the present invention. Cleaner 10 is shown in a side elevation view. Cleaner 10 includes an outer shell 12 defining the outer configuration thereof. The exterior configuration of a cleaner 10 in accord with the present invention may vary from that shown herein. Shell 12, as noted, can have a variable configuration and is provided to enclose moving parts, provide a closed path for movement of the product therethrough, and to provide an airflow path for the movement of air under negative pressure therethrough, among other well known purposes to those skilled in the art. The outer shell 12 is manufactured from appropriate materials, such as sheet metal. The shell 12 has a lower portion 14 and an upper portion 16. The upper portion 16 includes an inlet 18 into a hopper 20 (best seen in FIG. 3) into which the dirty product 22 to be cleaned is deposited from an overhead conveyor, storage bin, or similar storage or conveying apparatus, though the latter is not critical to the present invention. Suffice it to say that some means must be provided for moving dirty product from a storage location to the hopper 20 and that such means is not included within the scope of the present invention.

Figure 3:
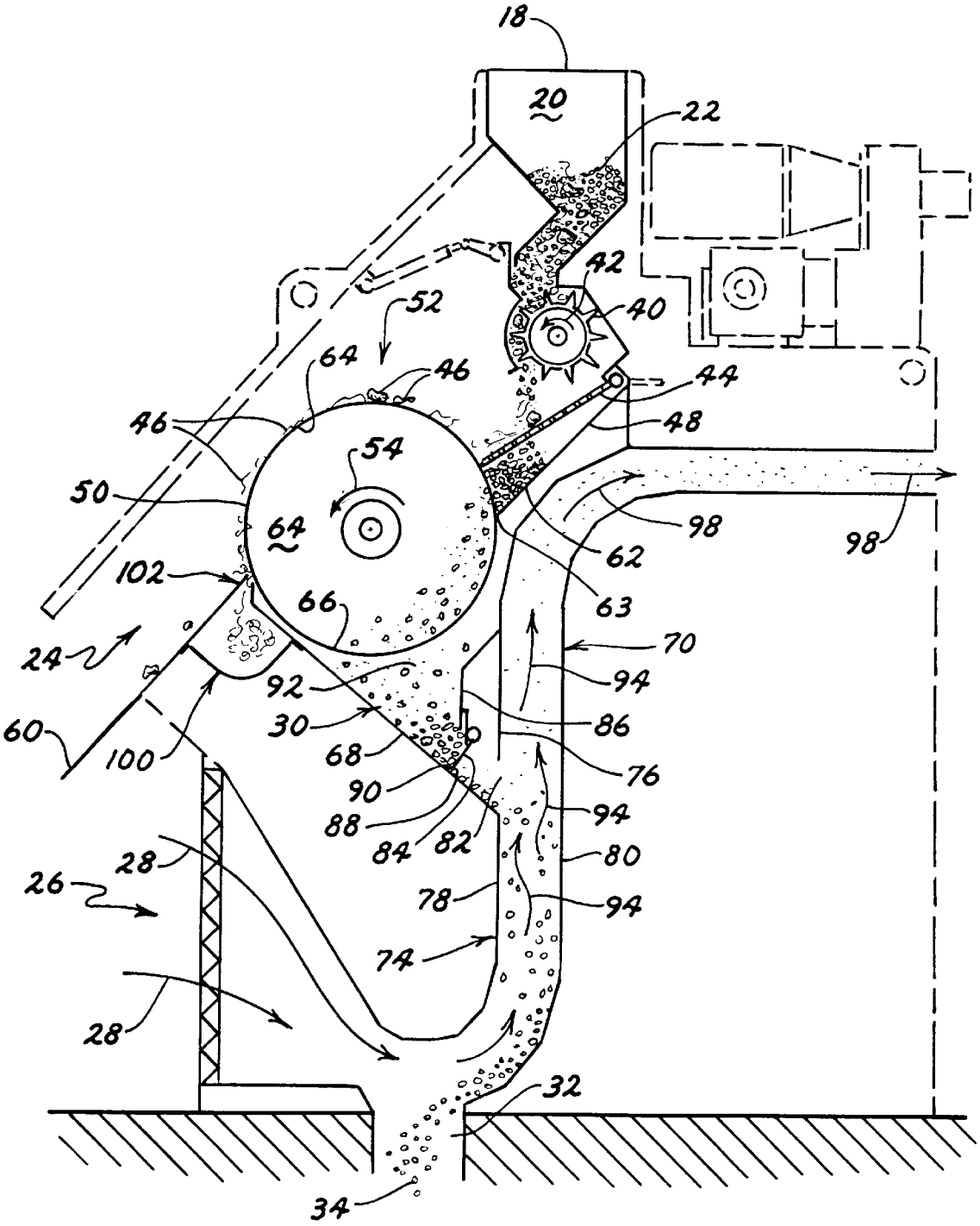
FIG. 3 illustrates the present invention in a partial side elevation, partial cross sectional view.

Shell 12 further includes a discharge opening 24 for materials removed from the dirty product 22 and an air inlet 26 for allowing air to freely flow into the cleaner 10 as indicated by curved arrows 28 in FIG. 3. As will be understood, this airflow is a negative airflow produced by means to be described later.

Referring now to FIG. 3, it will be observed that a product flow path 30 is provided for the dirty product 22 in hopper 20 through the cleaner 10 from the inlet 18 to an outlet 32 substantially directly below inlet 18 where clean product 34 exits the cleaner 10 and is deposited within a storage facility of some kind known to the art, is transported away from the cleaner 10 by means of a conveyor known to the art, or is handled in some other appropriate manner.

It will be seen that the cleaner 10 includes a feed roller 40 mounted therein. Roller 40 is mounted for rotational motion within shell 12 in a manner well known to the art, the rotary motion of the roller 42 being indicated by arrow 42. Roller 40 extends substantially the entire width of the cleaner 10 and is used to meter the flow of the dirty product 22 from the hopper 20. The roller 42 directs the dirty product 22 onto a comb 44, which separates large contaminants, such as rocks picked up during harvesting were the product grain, from the dirty product. Comb 44 comprises a plurality of elongate, space apart rods or fingers extending across the width of the cleaner 10 in a right to left, slightly downward direction when viewed in FIG. 3. As the dirty product 22 falls onto the comb 44, the larger contaminants 46, including angel hair and rocks are sorted from the dirty product 22, which in turn falls through the spaced apart fingers of the comb 44 onto a plate 48 that extends substantially the width of the cleaner 10. The sorted contaminants, however, are directed by the comb 44 onto the outer surface 50 of a scalping reel 52, which is mounted for rotational motion within shell 12, the rotary motion thereof being indicated by arrow 54. Scalping reel 52 may be a cylindrically configured screen (or appropriately attached cylindrical segments) having a plurality of apertures or perforations therein. Such a reel having perforations slightly larger than the plastic beads being cleaned would be acceptable in such an application of the present invention. Where the present invention was being used to clean grain or other particulate matter, however, it may be desirable to use a scalping reel 52 comprising a woven wire cage. The use and construction of such scalping reels 52 and combs 44 are well known in the product cleaning art and will not be discussed further except as necessary to explicate the present invention.

It will be seen therefore in viewing FIG. 3 that the rotation of the reel 52 carries the contaminants 46 sorted by comb away from the unsorted material and onto a chute 60 forming the lower wall of the agglomerate discharge 24. These larger contaminants will fall off the outer surface 50 of the scalping reel 52 as it rotates and onto the chute 60 and from there will drop out of the cleaner 10 into the appropriate waste collection device (not shown).

Still referring to FIG. 3, it will be observed that plate 48 slopes downwardly toward the scalping reel 50 and has a lower end 62 that terminates in close proximity to the outer surface 48 of the scalping reel 50. End 62 is disposed from the outer surface 48 to create a gap 63 having a depth less than the minimum size of the product so as to ensure that the product passes through the apertures in the reel 52. As seen in the Figure, the dirty product 22 passes through the apertures of the scalping reel 52 and into the interior 64 thereof. The dirty product 22 continues to fall under gravitational influence in this configuration of the present invention onto the lowermost portion of the inner interior surface 66 of reel 52 such that the product can again be sorted by the apertures in the reel 52. As the dirty product 22 falls through the reel apertures a second time, it is received on the upper surface of a diagonally disposed catch plate 68 that empties the downwardly falling dirty product 22 into a substantially vertically disposed aspiration column 70. As will be described in greater detail later, the aspiration column 70 has a negative airflow moving therethrough that blows or lifts the lighter material out of the dirty product 22 leaving cleaned product 72 to fall downwardly within the column and out through discharge outlet 32.

The aspiration column is defined in part by a rear wall 74 comprising upper and lower aspiration column wall portions 76 and 78, respectively and a front wall 80. The upper and lower rear wall portions 76 and 78 cooperate to define a gap 82 through which the dirty product 22 falls into the aspiration column 70. To control the amount of dirty product 22 falling into the aspiration column, gap 82 is metered by a gate 84 that is attached to an angularly depending member 86 that is in turn attached to the upper rear wall portion 76. The gate 84 has a terminal end 88 spaced apart from catch plate 68 so as to form a gap 90 to allow dirty product to fall therethrough at a controlled rate. Gate 84 is loaded by counterweights to allow larger quantities to flow through to prevent the dirty product from plugging up the volume 92 beneath the scalping reel 52. Thus, when dirty product 22 builds up within the volume 92 its weight will cause the gate 84 to open to swing against the counterweights (not shown) into a more open position to increase the flow of dirty product 22 through the gap 90 and into the aspiration column 70.

The aspiration column 70 has an intake 26 as previously indicated. Air flows inwardly into the cleaner 10 as indicated by arrows 28 over the discharge outlet 32 and into the aspiration column 70, flowing through the downwardly falling product as it moves through the cleaner 10. Dust and other lightweight contaminants can be lifted out of the dirty product 22 and carried upwardly away from the heavier downwardly falling product. The upward air flow through the dirty product is indicated by arrows 94. This air flow 94 carries the light weight contaminants into a substantially horizontally disposed outlet 96 (FIG. 1) as indicated by arrows 98.

Figure 2:
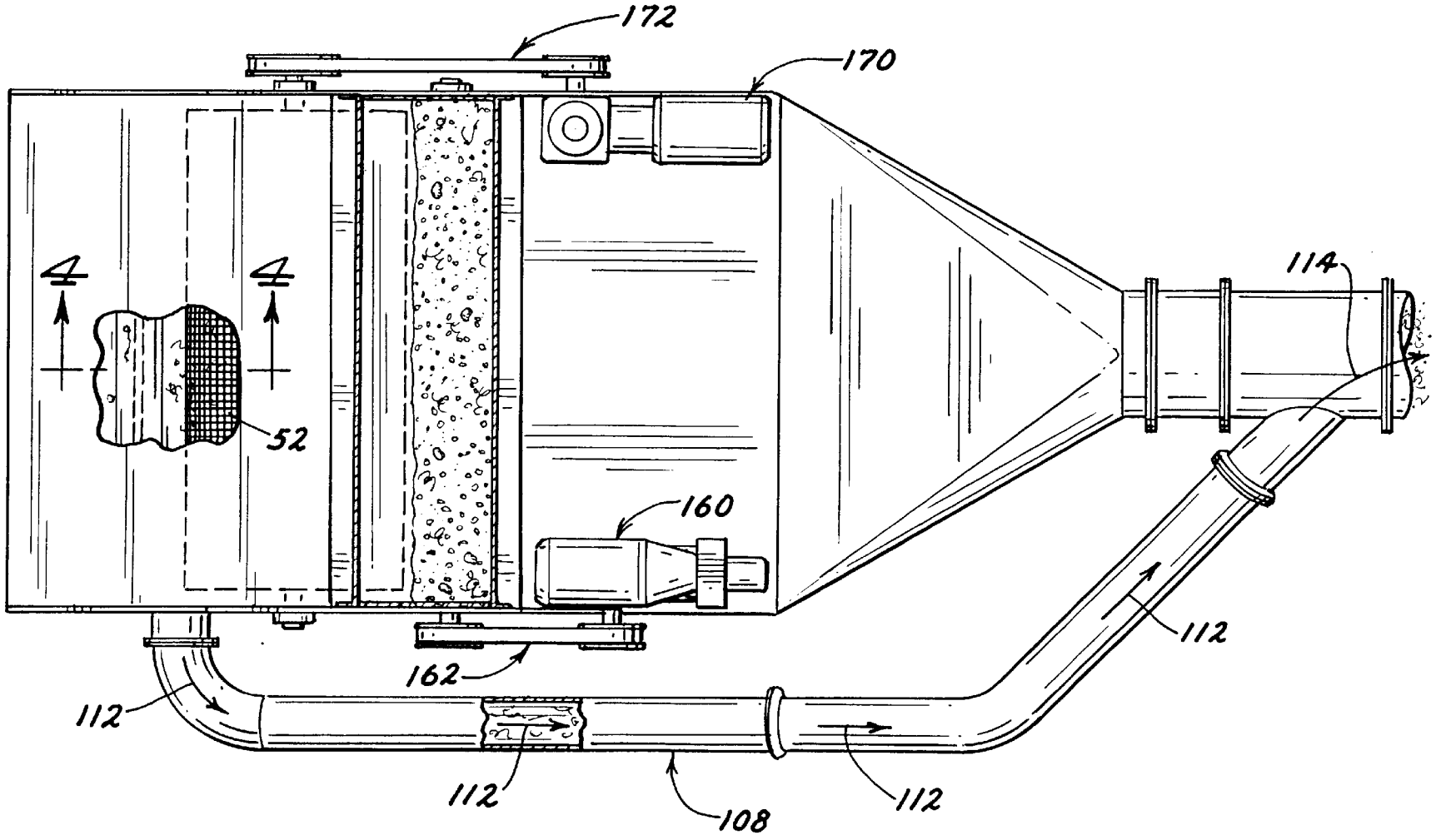
FIG. 2 illustrates the present invention in a top plan, partial cross sectional view.
Figure 4:
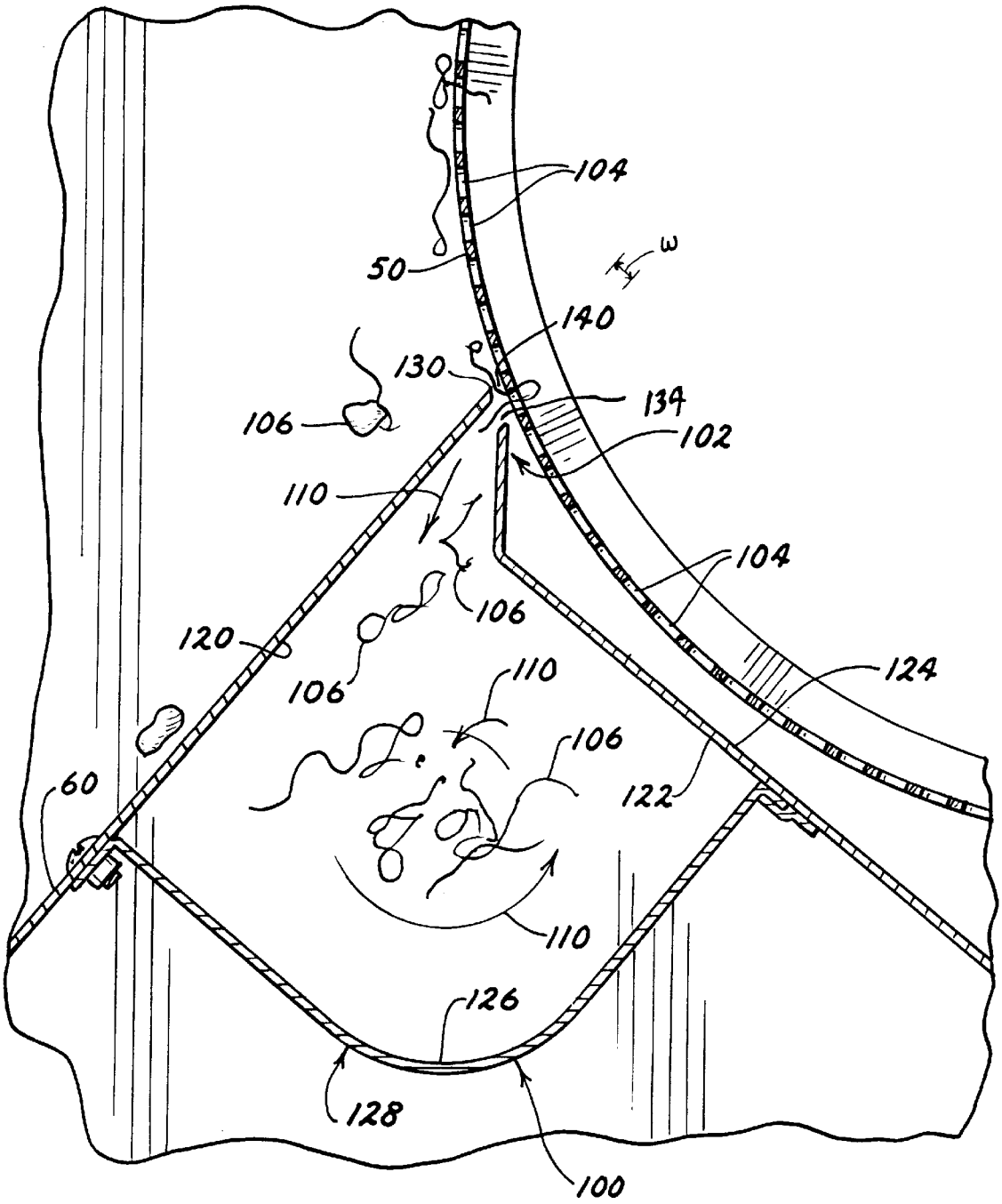
FIG. 4 illustrates a nozzle in position relative to a rotating screen in accord with the present invention in a partial side elevation, partial cross sectional view.

Referring primarily to FIGS. 2–4 now, the present invention will be further explained. As previously discussed, contaminants such as angel hair or other materials may become lodged or otherwise trapped in the apertures in the scalping reel 52 as it rotates. These contaminants may become entrapped within these apertures after they fall off comb 44 or as the dirty product 22 passes through the scalping reel apertures. To prevent this material from coming free as the scalping reel 52 completes a rotation, it is necessary to attempt to remove the materials prior to their presentation of the outer surface 50 to the volume 94 since the contaminants may fall into the product again as it waits to pass through gap 90 between gate 84 and catch plate 68 and be too heavy for the air flow 94 to remove from the product. In such a circumstance, the contaminants would fall with the product into the outlet 32 and in with the supposedly cleaned product 34. In addition, as the contaminants become lodged in the apertures of the scalping reel 52, the efficiency of the cleaning process will be slowed as the reel apertures get plugged. Removal of these contaminants is thus desirable.

As previously noted, the prior art tried to remove such materials from the apertures of the scalping reel 52 by means of rotating brushes or elongated beaters that beat against the outside surface 50 of the reel 52.

The present invention includes a vacuum plenum 100 having a nozzle 102. As best seen in FIG. 4, scalping reel 52 includes apertures 104 in which contaminants such as angel hair 106 can be lodged. The vacuum plenum 100 is attached to a plenum return 108 (FIGS. 1 and 2) connected to the outlet 96. Thus, the negative air flow in the direction of the nozzle 102 through the vacuum plenum return 108 to the outlet 96, as indicated by arrows 110, 112, and 114, respectively, creates a suction or vacuuming effect that removes the entrapped contaminants such as angel hair 106 from the apertures 104 of the scalping reel 52. The negative air flow through the cleaner can thus be utilized to clean the scalping reel 52 and improve the cleaning efficiency of such a cleaner 10.

As best seen in FIG. 4, vacuum plenum 100 is defined in part by the inner surface 120 of chute 60, in part by the inner surface 122 of the plate 124, which also partially defines the volume 94, and in part by the inner surface 126 of a plenum wall 128. Nozzle 102 in turn is formed by the terminal upper end 130 of the chute 60 and the terminal end 132 of the upper and angularly disposed end of the plate 124. As such, the nozzle 102 is defined by the gap between termini 130 and 132.

Nozzle 102 defines a nozzle opening 134 having a length that extends substantially the entire length of the scalping reel 52 and a width w, thereby in the present embodiment defining a substantially rectangular nozzle opening. Nozzle 102 must be gapped from the outer surface 50 of the scalping reel 52 such that no or minimal contact between the two will occur due to out-of-round rotation of the scalping reel. It will be observed in viewing FIG. 4 that terminal end 130 is spaced from the outer surface 50 of the scalping reel 52 by a gap 140. Gap 140 must be of sufficient size that the terminal end 130 does not engage surface 50 during out of round rotations of the scalping reel, but must also be smaller than the the width w of the nozzle opening 134 of the nozzle 102. The size of this gap is important since if it were larger than the width w of the nozzle opening 134, for example, contaminants could pass through the gap 140 and plug the nozzle 102.

Thus, a cleaner 10 according the present invention includes vacuum means for cleaning the scalping reel. The vacuum means includes a nozzle that extends substantially the entire length of the scalping reel so as to be able to remove contaminants from its entire length as the reel rotates. The contaminants enter the vacuum plenum and are removed therefrom by the negative airflow through the plenum return, which is connected to the outlet for the aspiration column of the cleaner. The outlet is in turn connected to an appropriate source of negative air flow, such as a fan of sufficient size and power to create the air flow through the cleaner 10 as desired.

It will be observed that the plenum return 108 exits from the side of the cleaner 10 and extends generally parallel to the longitudinal length of the cleaner 10 until it bends inwardly to engage the outlet 96.

Referring now to FIGS. 1 and 4 principally, it will be seen that cleaner 10 includes a feed roller drive motor 160 that drives the feed roller 40 by means of a belt drive 162. Similarly, cleaner 10 further includes a scalping reel drive motor 170 that drives the scalping reel 52 by means of a belt drive 172. Both motors 160, 170 and their respective belt drives (or chain drives if desired) 162, 172 respectively are well known within the art and will not be described further, except to say that they provide the previously referred to rotary motion of the feed roller 40 and scalping reel 52 in a known manner.

The present invention thus provides a novel method and apparatus for cleaning a dirty product, including the steps of introducing a dirty product to a cleaner having a scalping reel; feeding the dirty product onto the outer surface of the scalping reel such that contaminants larger in size than the apertures of the scalping reel are carried away from the remainder of the dirty product while the remainder passes through the apertures into the scalping reel and back out again to be fed into a substantially vertical aspiration column for the removal of contaminants lighter than the desired product. The method also includes vacuuming the scalping reel to remove contaminants lodged or otherwise attached to or trapped within the apertures, the outlet of the vacuum nozzle engaging the scalping reel being joined with the outlet of the aspiration column so that a single air flow source may be utilized to provide the necessary airflow for the airflow cleaning steps.

The present invention having thus been described, other modifications, alterations, or substitutions may now suggest themselves to those skilled in the art, all of which are within the spirit and scope of the present invention. For example, while the present invention has been illustrated as using a single air source, a separate independent air source could be provided for the vacuum nozzle 102. It is therefore intended that the present invention be limited only by the scope of the attached claims below.

What is claimed is:

1. A cleaner for removing contaminants from a dirty product, said cleaner comprising:

a scalping reel having an outer surface and an inner surface and a plurality of apertures extending between said inner and outer surfaces;

means for feeding dirty product onto the outer surface of said scalping reel, wherein said product and contaminants smaller than said apertures pass therethrough into the interior of said scalping reel and through said apertures out of said scalping reel as said scalping reel rotates; and a vacuum, said vacuum disposed in close proximity to said outer surface for removing contaminants engaging said apertures.

2. The cleaner of claim 1 and further comprising:

an aspiration column, said column being provided to receive product passing through said scalping reel apertures, said column being substantially vertically oriented having an aspirating air flow directed upwards through said aspiration column, wherein the air flow through said aspiration column substantially removes contaminants lighter than said product.

3. The cleaner of claim 1 and further comprising:

an aspiration column, said column being provided to receive product passing through said scalping reel apertures, said column being substantially vertically oriented having an aspirating air flow directed upwards through said aspiration column, wherein the air flow through said aspiration column substantially removes contaminants lighter than said product, said lighter contaminants being carried by said air flow out of said cleaner through an air flow outlet and said product falling through said air flow to a product outlet from said cleaner.

4. The cleaner of claim 1 and further comprising:

said scalping reel having a substantially cylindrical configuration; and said vacuum including a nozzle having a width substantially equal to the width of said scalping reel.

5. The cleaner of claim 4 and further comprising:

said nozzle defining a nozzle opening having a length and a width and being spaced from said outer surface of said scalping reel by a distance less than the width of said nozzle opening.

6. The cleaner of claim 5 wherein said vacuum further includes a vacuum plenum and a plenum return, said plenum return being fluidly connected to said air flow outlet such that contaminants removed by said vacuum and said aspiration column are exhausted from said cleaner by a single discharge outlet.

7. A method for removing contaminants from a dirty product, said method comprising:

introducing a dirty product to a cleaner having an air flow therethrough and a rotatable scalping reel including a plurality of apertures of preselected size and configuration;

feeding the dirty product onto the outer surface of the scalping reel such that contaminants larger in size than the apertures of the scalping reel are carried away from the remainder of the dirty product while the remainder of the dirty product passes through the apertures into the scalping reel and back out again; and vacuuming said scalping reel to remove contaminants engaging said scalping reel apertures.

8. The method of claim 7 wherein said method further includes:

exhausting contaminants removed by said vacuuming from a single airflow outlet of said cleaner.

9. The method of claim 7 wherein said cleaner further includes an aspiration column with an air flow therethrough, said method further including:

aspirating said product remainder by delivering said product remainder to said aspiration column for the removal of contaminants lighter than the product by said air flow passing through said product and blowing said lighter contaminants away from said product.

10. The method of claim 9 wherein said method further includes:

exhausting contaminants removed by said vacuuming and aspirating from a single airflow outlet of said cleaner.

11. The method of claim 9 wherein said aspiration column is substantially vertically oriented.

* * * * *